United States Patent [19]

Hummel

[11] 3,964,216

[45] June 22, 1976

[54] MODULAR BUILDING CONSTRUCTON

[75] Inventor: Roger A. Hummel, Suttons Bay, Mich.

[73] Assignee: G. Tsutomu Arai and Roger A. Hummel, Architects, Suttons Bay, Mich.

[22] Filed: Oct. 31, 1974

[21] Appl. No.: 519,611

[52] U.S. Cl. ..... 52/79; 52/73; 52/23 C; 52/237

[51] Int. Cl.² ..... E04B 1/34

[58] Field of Search ..... 52/79, 236, 70, 66, 52/109, 237, 475, 73; 312/111, 107

[56] References Cited

UNITED STATES PATENTS

| | | | |
|---|---|---|---|
| 1,726,121 | 8/1929 | Polkosnik | 312/111 |
| 2,751,635 | 6/1956 | Donnahue | 52/79 |
| 3,331,170 | 7/1967 | Lowe | 52/79 |
| 3,430,398 | 3/1969 | Green | 52/236 |
| 3,466,828 | 9/1969 | November | 52/475 |
| 3,500,595 | 3/1970 | Bennett | 52/79 |
| 3,696,574 | 10/1972 | Dietrich | 52/79 |
| 3,744,196 | 7/1973 | Weese | 52/70 |
| 3,754,805 | 8/1973 | Pangburn | 312/111 |
| 3,785,096 | 3/1971 | Neuhardt | 52/237 |
| 3,792,558 | 2/1974 | Berce | 52/79 |
| 3,835,601 | 9/1974 | Kelbish | 52/79 |
| 3,871,146 | 3/1975 | Hamy | 52/79 |

FOREIGN PATENTS OR APPLICATIONS

| | | | |
|---|---|---|---|
| 1,441,807 | 5/1966 | France | 52/79 |
| 1,443,198 | 5/1966 | France | 52/79 |
| 1,914,480 | 8/1970 | Germany | 52/79 |
| 174,067 | 4/1922 | United Kingdom | 52/237 |
| 360,185 | 11/1931 | United Kingdom | 52/237 |

*Primary Examiner*—Ernest R. Purser
*Assistant Examiner*—Henry Raduazo
*Attorney, Agent, or Firm*—Whittemore, Hulbert & Belknap

[57] ABSTRACT

The building construction is an assembly of any desired number of like individual block-like components which are in the main of wood, each externally and/or internally sheathed with a skin, preferably of plyboard or the like; and each unit affords at least one occupancy space, such as a livingroom, bedroom, kitchen, office, etc. Said blocks each have the outline in a transverse upright plane of an equilateral parallelogram, more specifically as shown herein an oblique-angled parallelogram or rhombus which is disposed with its major diagonal in a horizontal plane. Such blocks are rigidly connected or stably pivoted together at their ends and/or sides, as by bolted steel bracket plate units, in end-to-end and/or side-by-side relation at the apices or major or minor diagonals thereof, being in any desired rectilinear end or side array, or in a laterally staggered arrangement.

13 Claims, 14 Drawing Figures

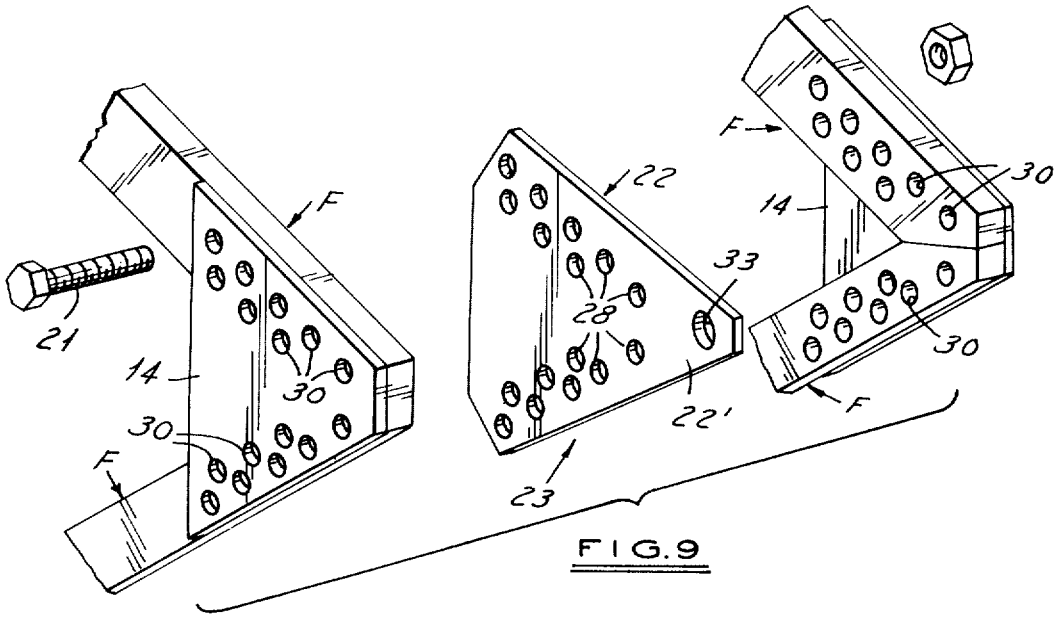
FIG. 9
FIG. 10
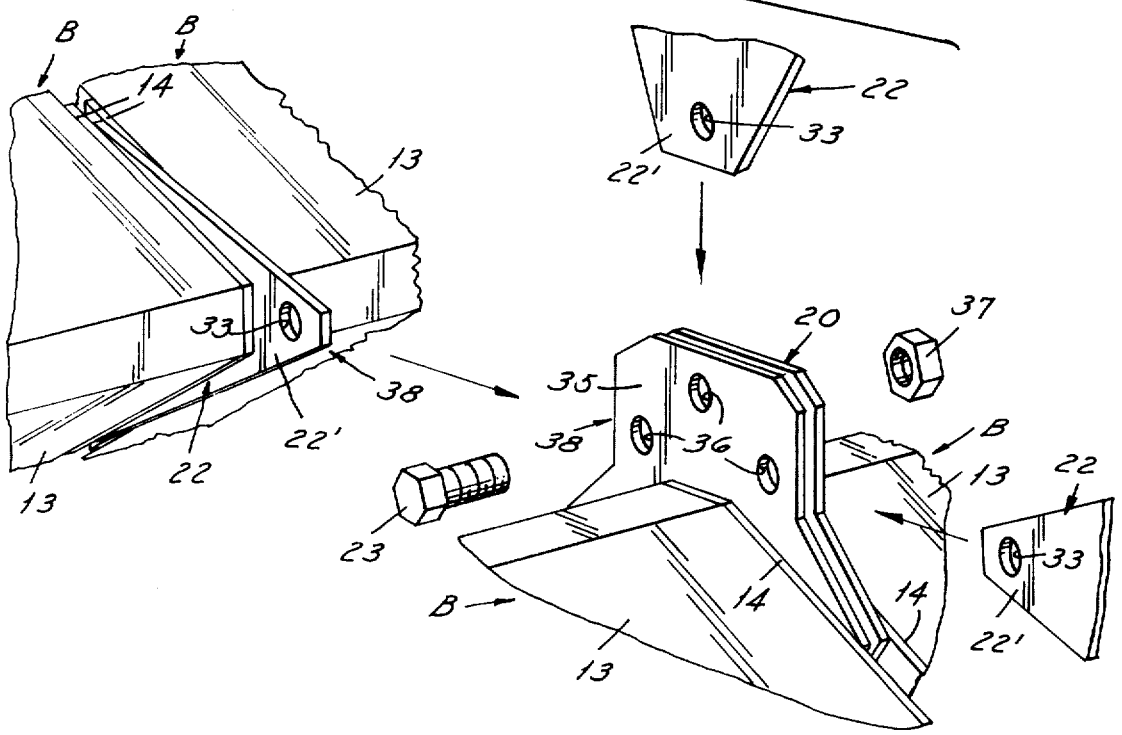

FIG. 11
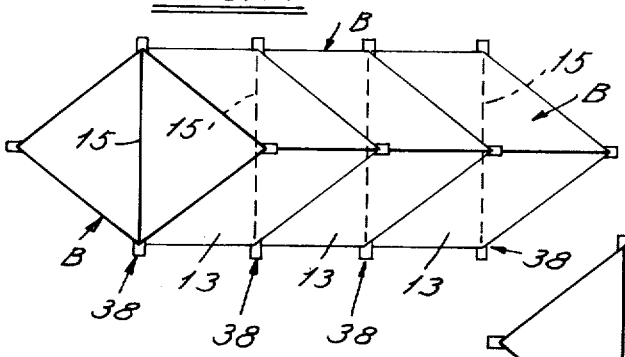
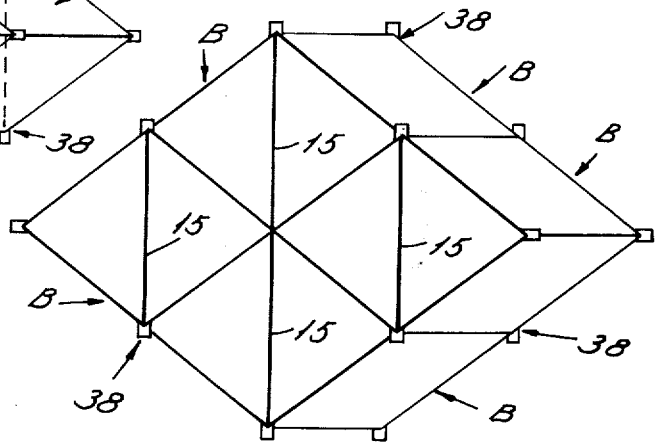
FIG. 12
FIG. 13
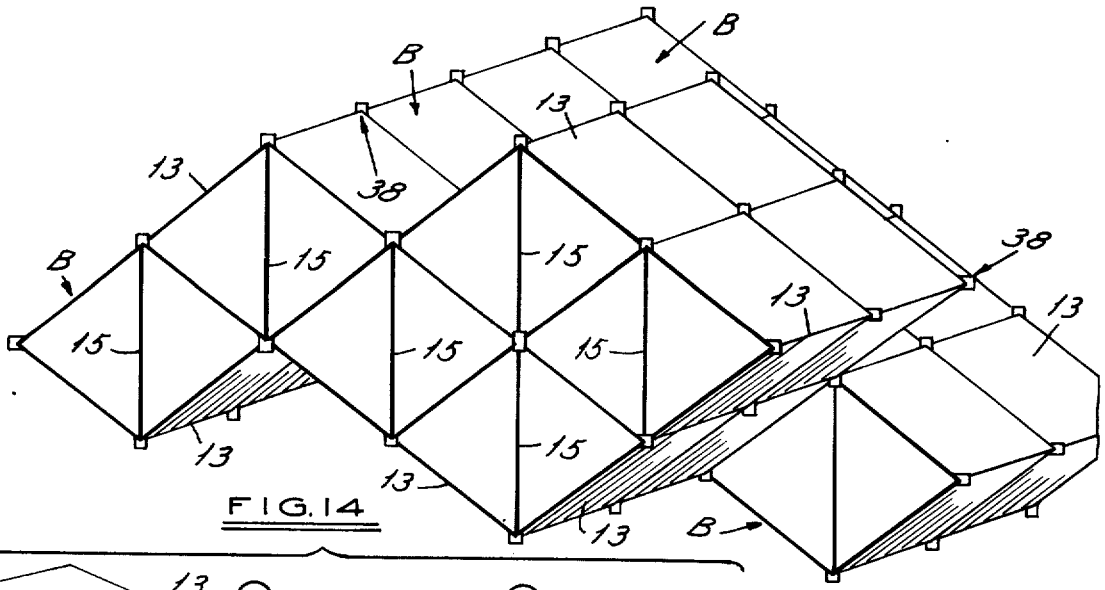
FIG. 14
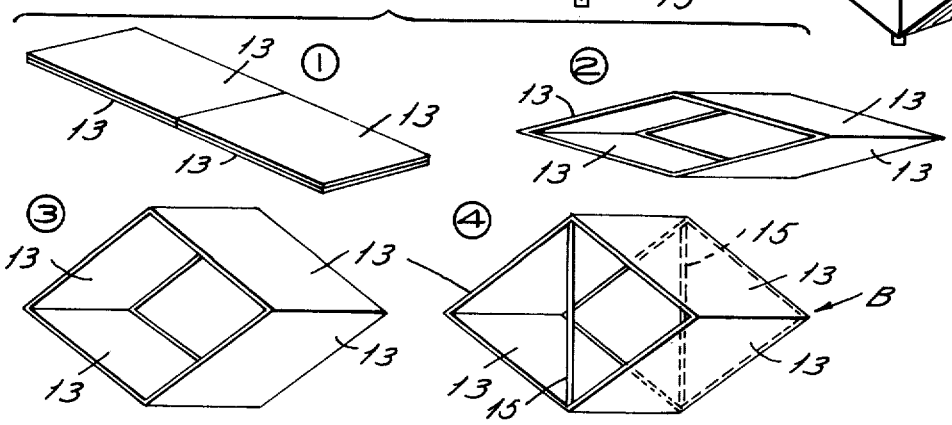

MODULAR BUILDING CONSTRUCTON

BACKGROUND OF THE INVENTION

Individual blocks of arrangements as disclosed and claimed herein are each preferably constituted by a number of substantially identical, laterally spaced frame components having the same quadrilateral outline in their planes as that of the block; and these frames are stiffened and braced against relative shift by the sheathing of the block. End frame components of each block are further rigidified to have a truss effect by upright members extending along a diagonal of the parallelogram block outline, thereby in effect subdividing it into two triangular portions or sections each having geometrically inherent rigidity.

The component frame members of each block, as rigidly secured together in their spaced relation transverse of their planes, are further braced individually by wooden corner gussets nailed or glued thereon, which supplement their block's end-trussed strength; and the bolted steel end plates which rigidly articulate successive blocks end-wise and/or side-wise afford strong multiple trussings of the totality of block units of the modular building construction as a whole.

By great preference, the end-wise and side-wise connections of the individual blocks are such as to afford relatively generous spaces therebetween, in which spaces electrical or plumbing conduitry, thermal and/or acoustical insulating material, and the like may be disposed. Rigid or structurally stable connections of individual blocks to one another are substantially solely at the bolted steel end bracket means referred to, although of course other incidental interconnections of frames and blocks may arise in the complete structure. The construction is entirely stable and self-supporting as a whole, requiring no internal or external columns, pillars, beams or other conventional type supports, other than such as are of course necessary at end block units for a pier-type footing on the ground or other basic support surface. A multiply trussed and cantilevered effect characterizes any combination of two or more blocks pursuant to the invention.

The modular building construction finds many applications of the sort in which any other type of modular building construction is employed, for example, in low-cost housing, in motels, apartments or the like, in commercial settings, or even in industrial instances.

A search has revealed the following patents:

| | | |
|---|---|---|
| Tilden | 514,789 | Feb. 13, 1894 |
| Tourtellotte | 2,241,830 | May 13, 1941 |
| Van der Lely | 3,292,327 | Dec. 20, 1966 |
| Camoletti et al | 3,363,370 | Jan. 16, 1968 |
| Mead | 3,527,002 | Sept. 8, 1970 |
| Lopez et al | 3,608,257 | Sept. 28, 1971 |
| Neuhardt | 3,785,096 | Jan. 15, 1974 |

Of the above patents, Lopez et al discloses a modular building arrangement in the form of an assemblage of hexagonal room space-affording components; it lacks practically all of the advantages of the present improvement, and in addition requires resort to upright pillars, horizontal floor and ceiling beams, and the like throughout the assembly, as distinguished from the rigidly self-sustaining and supporting characteristic of the present invention.

The other listed references are of only casual interest. Van der Lely suggests in its FIG. 26 a laminar-type build-up of reinforced concrete parts totally unlike the spaced frame block unit of my invention. This patent, and also Tilden, Tourtellotte, Camoletti et al, Mead and Neuhardt simply disclose versions of construction involving modules which may be linearly connected or stacked in series, or alternated in a zig-zag fashion. These are of only the most general sort of similarity to the modular concept of the present invention, involving apex-connected component units in a cantilever array.

SUMMARY OF THE INVENTION

The present modular construction of essentially wooden blocks steel plate and bolt-anchored and truss-articulated to one another at their longitudinal ends and/or side-wise at major or minor diagonal apices of their parallelogram or rhombus outline, is extremely versatile in its adaptability to the construction in multiple designs and sizes of housing structure, for example in urban, suburban or rural developments, in motels, condominiums, apartments, offices, etc. It is adapted to economically occupy great spaces, either at a ground level or above, and regardless of the topography of the terrain; it may be built up directly on or over the latter, in some cases bridging considerable areas. Versatility as to area expansion also exists in the direction at 90° to the planes of the major and minor diagonals, since the blocks may also be connected, and added to as desired, in parallel end-to-end relation to one another. The same is true in the transverse or side-wise sense, or in combined staggering or stacking of multiple block units. Overall rigidity of construction attributable to the end bracket and bolt or stud connections of block components and sheathed frame sub-components thereof is at the outset basically imparted by the truss nature of the end frames of the individual blocks, as subdivided into triangles by upright timbers; and even more importantly, any of many possible combined block arrangements is as a whole strongly trussed at its block ends and/or sides by the same bolted bracket means as braces the ends of each block component.

In addition, the arrangement of the blocks, as thus rigidly or stably pivotally coupled to one another, is such as to afford dead spaces between adjacent units which may be occupied by various types of service equipment, such as electrical wiring, plumbing, etc., and such spaces may be further filled with acoustical and/or thermal insulating material, heating or cooling equipment, etc. Sub-floor spaces also offer potential service and/or storage advantages.

What is more, the individual block units are pivotally collapsible about their articulating bolted bracket connections to a very compact flat shape, enabling the units to be mass trucked from the prefabricator to the erection site, where they may be individually set up and end-trussed in their quadrilateral outline.

BRIEF DESCRIPTION OF THE DRAWINGS

FIG. 9 is a fragmentary exploded perspective view showing the manner in which end frame members of successive end-to-end connected block units are rigidly interconnected by steel plate bracket members for a longitudinally cantilevered succession, the bracket being a component of the coupling arrangements illustrated in FIGS. 5 and 6;

FIG. 10 is another exploded perspective view illustrating the manner of rigidly interconnecting built-up block units in side-to-side and/or end-wise stacked relation to one another;

FIG. 11 is a highly schematic perspective view depicting a simple arrangement of end-to-end block units interconnected to one another in a cantilever truss fashion;

FIG. 12 is another highly schematic perspective showing block units similarly bracket interconnected side-to-side to one another;

FIG. 13 is a still further schematic perspective depicting a side-to-side and end-to-end combination of the block units; and FIG. 14 schematically shows four steps contemplated in a procedure of erecting knock-down stud or bolt-articulated block units, each prefabricated and carrying side sheathings, to a stably erected and truss-braced block pursuant to the invention.

DESCRIPTION OF A PREFERRED EMBODIMENT

Figure 1:
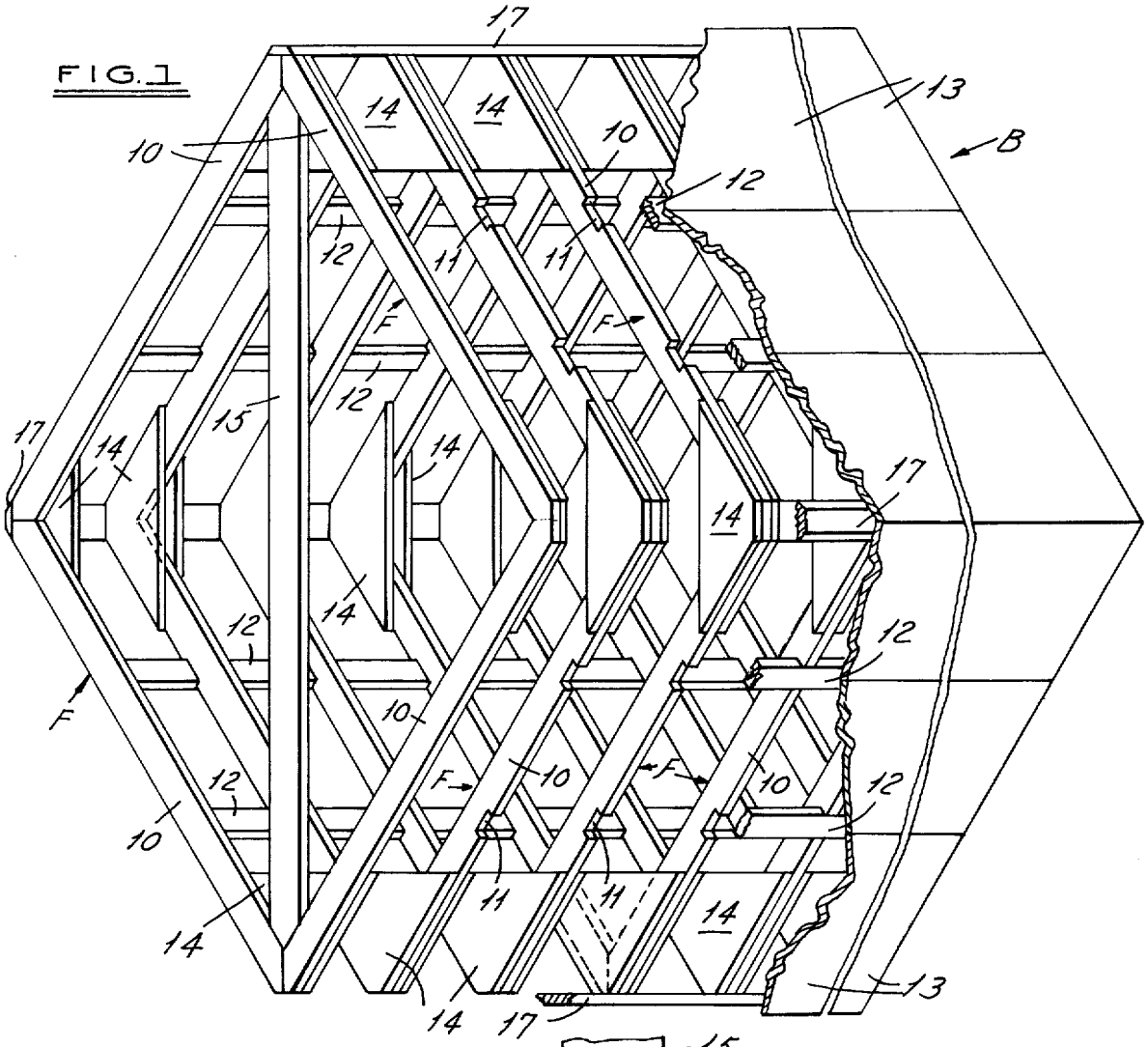
FIG. 1 is an out-of-scale isometric view, very schematic and partially broken away, illustrating a typical block unit for a modular building construction pursuant to the invention, as constituted by substantially identical rhombus-shaped frame members locked in parallel transversely spaced relation to one another, no attempt having been made to show certain bracket connector means by which block units of this type are articulated to other such units.

FIG. 1 of the drawings schematically shows a typical basic modular block component, generally designated by the character B, to be comprised of a plurality of component frame members F disposed in parallel transversely spaced relation in a direction at 90° to their planes. In a typical such block the spacing of the frames from one another, i.e., longitudinally or at 90° to their planes, will be, say, of the order of 14 inches – 16 inches on centers, although this dimensioning is of course subject to change. The overall length of the block will be typically 20 feet, and the height of the block on a vertical or minor diagonal in the instance chosen for illustration will be 14 feet. As appears best in schematic FIGS. 1 and 2, straight side perimetral members 10 of the several frames F are notched at 11 to receive horizontal stringers 12 which support and are rigidly braced and longitudinally connected in succession by external sheaths or skins 13 encasing the four sides of block B. The invention also contemplates a similar internal sheathing of the block, either by way of supplementing or substituting for the external skins. In any case, the sheathing 10 contributes importantly to the rigidifying and stabilization of the block B as a whole.

Top, bottom and side gussets 14 brace the individual frame members F adjacent diagonal extremities thereof, and may be of ⅝ inch plyboard glued and nailed to the sides of the members 10 adjacent the apices thereof; the end-most such gussets are drilled to receive, in common with certain steel bracket means later referred to, steel connecting bolts or studs, such connections being contemplated only at the ends of each block B. The gussets 14 come substantially flush with external edges of the several frames F, and contribute to an overall construction by which the block is materially individually strengthened and rigidified.

Figure 2:
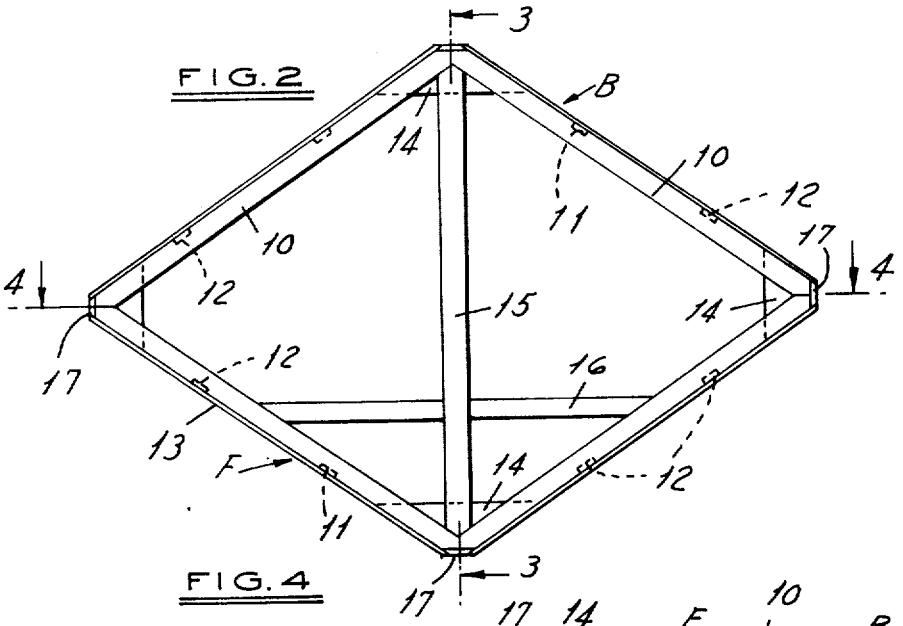
FIG. 2 is a schematic end elevational view of the basic block of FIG. 1, further illustrating the use of stringer timbers spanning the frame members and serving as a support for the unit's bracing skin or sheathing, as well as showing transverse floor joist means.
Figure 4:
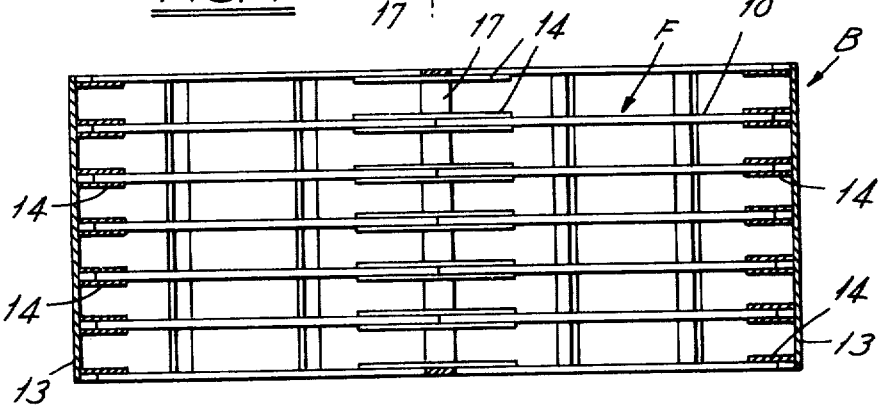
FIGS. 3 and 4 are, respectively, views in cross section on lines 3—3 and 4—4, respectively, of FIG. 2.
Figure 3:
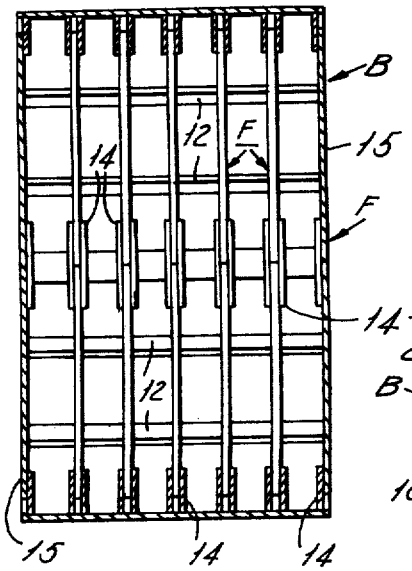

FIGS. 1 and 2 best further show the block as being as a whole inherently braced and rigidified by an upright strut 15 at each of the two longitudinal extreme end frames of the block, this strut occupying the line of a diagonal (a minor diagonal as appears in FIG. 2), across the end frame. It thus subdivides each of said two frames into triangular sections which are inherently and geometrically stable and resistant to collapse in their own plane; and this is another feature of importance in the invention.

The same effect is to some extent attained through the agency of horizontal floor joists 16 (FIG. 2) which afford bracing triangular portions or sections at the several frame members F throughout the length of the block B. As a typical example, subject of course to modification, the floor joists and stringers 12 may be 2 × 6 timbers, the gussets 14, if made of wood (although other choices are available), may be ⅝ inch plyboard, as may also be preference only be the external sheathing 13. Top, bottom and side cap timbers 17, otherwise similar to the stringers 12, may be 2 × 8 lengths.

As best appears in FIG. 2, the outline of the strut, gusset and bracket-braced block B is that of its component frame-members F. It is as shown an equilateral parallelogram; more specifically it is an equilateral oblique-angled parallelogram or rhombus. Yet, in certain instances it may be desirable to resort to an oblique-angled parallelogram having only its opposite sides of equal length, i.e., a rhomboid. As a further possibility, the frame outlines may at some or all locations of the built-up modular construction be triangular overall or even have some non-parallel sides, especially when a stable and non-collapsible geometry is present.

An important advantage of the invention is that factory-fabricated blocks B may be trucked or otherwise shipped in multiple in individually collapsed compact flat form, for erection on location by relatively unskilled labor, in the manner of FIG. 14, and thereafter assembled in combination to constitute modular constructions such as are schematically depicted in assembly in FIGS. 7–13.

Figure 8:
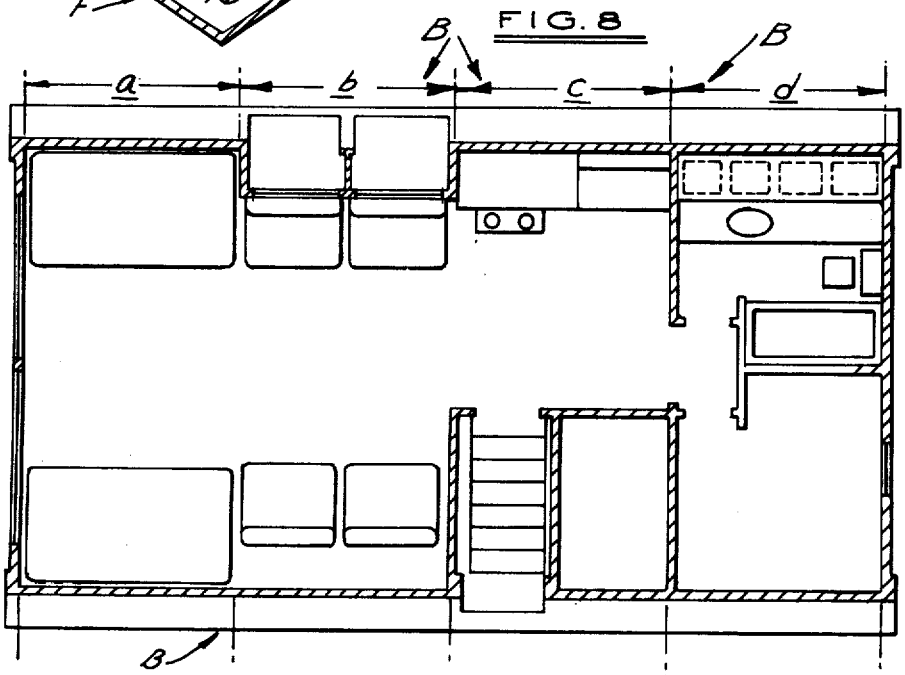
FIG. 8 is a typical schematic layout in plan of occupancy spaces constituted by a number of the individual block components of the invention subdividing a structure typically into housing areas.

FIG. 8 is a typical schematic floor plan of a housing layout which may be constituted in, say, four subdivisions *a*, *b*, *c* and *d* rigidly bracket-coupled together in the manner previously referred to, and to be described with special reference to FIGS. 5, 6, 9 and 10. As indicated above, the area covered by the modules may be expanded as desired, both at the apical bracket couplings, and in a lengthwise direction at 90° to the frame planes.

Figure 5:
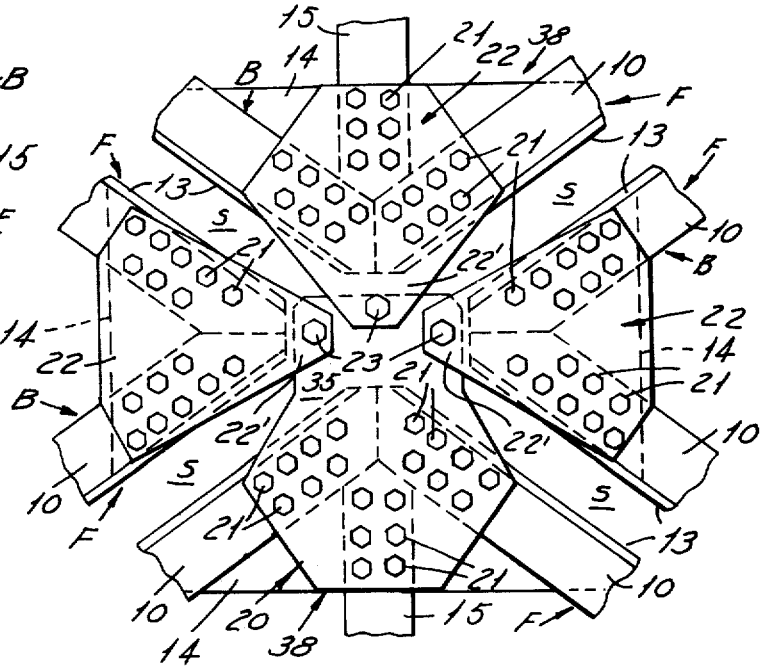
FIG. 5 is an enlarged scale fragmentary view illustrating one typical arrangement for rigidly coupling plural block units at diagonal apices thereof, in this instance a 4-way transverse junction of steel bracket and bolt or stud sub-assemblies, each of which individually also end braces its individual block.

FIG. 5 shows a typical interconnection in a side-by-side arrangement of four blocks B which leaves elongted service, insulation or similar accommodation spaces *s* between parallel sides of the angularly successive blocks. In the illustrated arrangement of FIG. 5, a bottom-most block end frame F has a relatively large steel plate bracket piece, specially designated 20, rigidly secured thereto by plural bolts 21, as at the minor diagonal of the rhombus frame; and the same bolts or studs serve in connecting bracket 20 to an associated block end frame gusset 14, as later described in reference to FIG. 9. As indicated previously, this gusset may be a plyboard part secured by gluing and/or nailing to the frame F, and FIG. 5 in addition shows the similar bolting of bracket 20 to the diagonal end bracing strut 15.

The remaining three end frame members F of their block sets are similarly equipped with generally triangular plate-like steel bracket parts 22. The sides of these brackets converge to truncated apices 22', adjacent which they are rigidly secured to end frame gussets 14 and to the other bracket 20, by connections to be further described with reference to FIGS. 9 and 10, said connections being single bolts designated 23 in the case of the articulation of each pair of adjacent bracket sets to one another. Thus, layouts such as appear in FIGS. 7 and 9–13, inclusive, are readily set up on location, due to the use of but one bolt connection at each end frame apex intersection of two adjacent blocks B.

Figure 6:
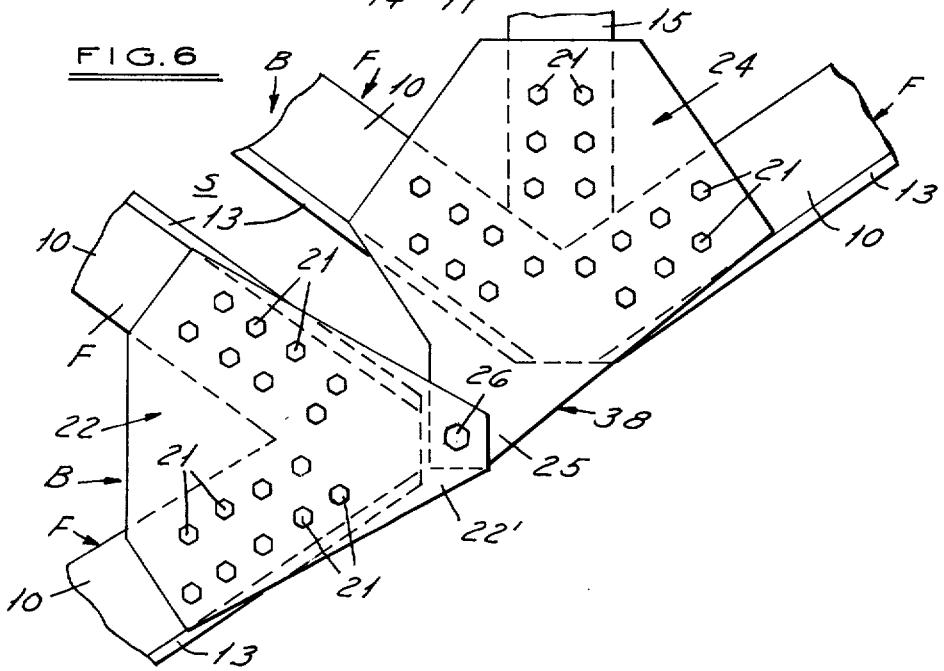
FIG. 6 is a fragmentary view similar to FIG. 5, illustrating another type of stud and bracket connection, in this case a 2-way linear junction, as at external side surfaces of the connected block units.

FIG. 6 depicts a special type of block union which may be resorted to at a side surface of a block layout, rather than at a central union such as that of FIG. 5. In this case, one of the end block units has a special steel bracket plate 24 featuring an angled extension part 25 at which a single stud or bolt connection 26, like that described and designated 23 with reference to FIG. 5, is effected. Otherwise, bracket-to-frame connections are of the sort referred to above, and require no further description.

FIG. 9 amplifies and further clarifies the disclosure of FIGS. 5 and 6 in regard to an elemental feature of the trussed end-wise interconnection of like end frame members of two blocks which may be later end-wise and/or side articulated in cantilever fashion in a building structure. FIG. 10 similarly details the procedure for such a side-wise interconnection of four blocks at a point laterally central thereof, per FIG. 5, and it is to be understood that procedures similar to FIGS. 9 and 10 will be followed in the interconnection of blocks B in a non-central or marginal way, as depicted in FIG. 6.

To these ends one of the specially shaped steel plates 22 is shown in FIG. 9 as being punched or drilled to provide holes 28 at multiple points adjacent its perimetral sides to receive the threaded studs or bolts 21 (see also FIGS. 5 and 6); these also extend through similarly located holes 30 drilled in the apical gusset members 14 of the endmost adjacent frame units of blocks B to be interconnected in end-to-end succession; and nuts 32 are tightly applied to the bolts 21 complete such an end-wise succession of two units. Others are similarly end-articulated in a desired number. Furthermore, each steel locking plate 22 carries a single larger diameter drilled opening 33 adjacent the end of its outer apex extension 22', for a purpose to be described.

FIG. 10 illustrates how the bracket-articulated block units B are rigidly articulated transversely and centrally in sets of four each such as appear in FIG. 5 to build up a side-to-side trussed combination of the blocks; and the same procedure is pursued in interconnecting end-wise a combination of but two marginally disposed blocks per FIG. 6. In the FIG. 10 arrangement the specially contoured steel bracket pieces 20 act as a sort of clevis receiving the apical extremities 22' of the three other steel brackets 22. Thus, as appears in FIG. 10, each of the special brackets 20 and corresponding ends of one of the block units is punched or drilled at its generally rectangular outer extension 35 to provide three holes 36 to receive the bolts or studs 23 of somewhat larger diameter than the frame interlocking bolts 21.

In inter-assembling blocks B in a side-wise articulated fashion, the steel plates 22 are interleaved between the clevis plates 22 (or 24) to bring their holes 33 in transverse register and alignment with the corresponding center-most bolt hole 36 of the clevis plate extensions 35, moving plates 22 in the directions indicated by arrows 10. Thus registered, the three studs 23 are inserted in all of the holes 33 and 36 and tightly taken up by nuts 37, thus completing the side-to-side interconnection of successive block units B.

Figure 7:
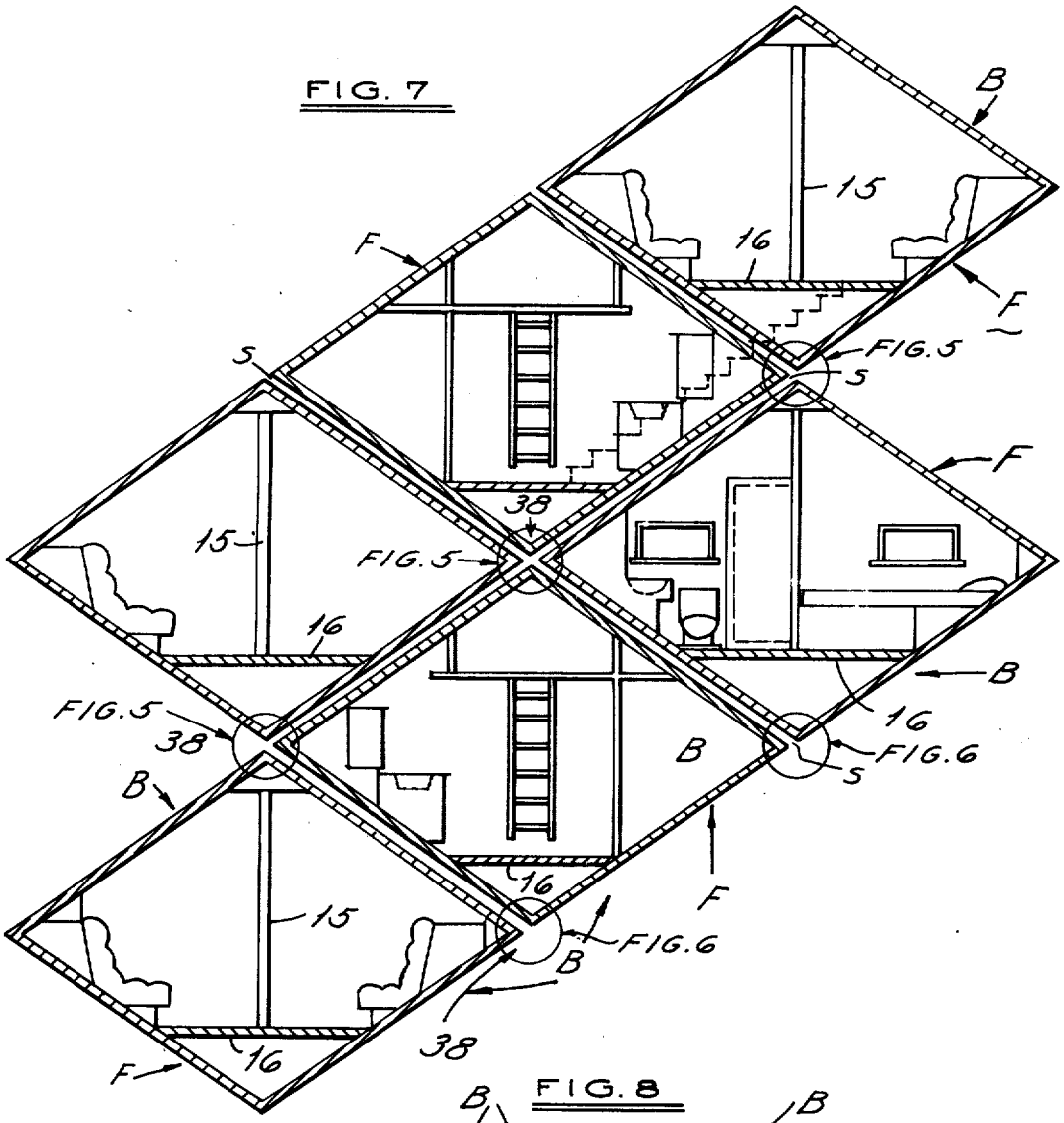
FIG. 7 is a schematic view illustrating one of many possible layouts of trussed modular block units, each enclosing one type of living or related occupancy space, as combined together in a combined longitudinally cantilevered and transversely staggered array, the view showing typical circled truss arrangements at which similar blocks are fixedly connected to one another to constitute building structures of various shapes and sizes.

Referring to FIG. 7, circles marked and identified with the numeral 5 show side-by-side rigid articulations of block units using steel plate interconnections of the sort depicted in FIG. 5 of the drawings; while at other locations involving only a marginal end articulation of blocks, the circled numeral 6 indicates such connections per FIG. 6 of the drawings. Thus, FIG. 7 shows a fairly simple cantilever trussed combination of longitudinally and transversely staggered block units B, each individually rigidified by the steel bracket plate connections, the end struts 15, the individual gussets 14, and the skins or sheathing 13 externally and/or internally applied to the frames F of the component basic blocks.

FIGS. 11–13, inclusive, further show types of lateral and longitudinal interconnections contemplated by the invention. Thus, FIG. 11 schematically relates to an end-to-end arrangement of individual blocks B in which the steel bolted plate connections (generally designated 38 in all of FIGS 5, 6 and 10–13) hold the blocks together and form a rigid turbular structure, of which the block struts, the sheathing and the stiffening gussets are also bracing parts. It is in essence a stressed-skin folded plate capable of spanning between lines of trussing formed by end frame panels perpendicular to the length of the tubular structure, and cantilevering lines of trussing.

FIG. 12 similarly depicts schematically a laterally stacked arrangement of multiple blocks individually connected at their sides by steel plate units 38, thus forming at the adjacent blocks a larger multiply trussed unit, the spacing of such trussing from one another being obviously along the length of the blocks.

FIG. 13 schematically depicts a more complex arrangement of the sort suggested in FIGS. 11 and 12, in which the connections of blocks are compounded at both linearly and transversely staggered locations, by means of connections 38. The truss space is, again, along the length of the blocks.

Finally, FIG. 14 schematically illustrates a fourstep procedure by which prefabricated block units as shipped in a flat, knocked-down condition appearing in FIG. 14 (1), are successively opened (FIG. 14 (2) and (3)) to the fully expanded parallelogram outline of FIG. 14 (4) in which the block is rigidified at its end frame members by the struts 15, the assembly in various ways with other like block units. Individual struts are, of course, bolted in place on the block diagonals prior to such assembly.

What is claimed is:

1. A modular building construction, comprising a plurality of generally similar basic block units each including at least two parallel, generally similar quadrilateral frames each having straight sides in effect intersecting one another in a common plane thereof, said frames being in a spaced relation to one another lengthwise and perpendicular to the planes of the same and having parallel vertical diagonals between opposed apices, means interconnecting said frames to one another to constitute the block unit, and bracket means adjacent an angular apex of a block unit outline to connect said unit to an adjacent block unit in major part by said bracket means, said basic block units, as thus bracket-connected together, having sides lying generally parallel to one another but being sufficiently spaced transversely from another adjacent block unit and throughout the length thereof to afford an elongated service or like space between said adjacent block units.

2. The building construction of claim 1, in which said frames are each quadrilateral and at least in part individually rendered geometrically stable and resistant to collapse in its plane by a strut component spanning a diagonal thereof.

3. The building construction of claim 1, in which said frames are at least in part individually rendered rigidly stable and resistant to collapse in its plane by gussets fixed thereto adjacent apices thereof.

4. The building construction of claim 1, in which said frames are at least in part individually rendered rigidly stable and resistant to collapse in its plane by gussets fixed thereto adjacent apices thereof, and by a strut component spanning a diagonal thereof.

5. The building construction of claim 1, in which said bracket-connected frames are at both longitudinally end-most extremities of said block unit.

6. The building construction of claim 1, in which said bracket-connected gusset and strut-stabilized frames are at the longitudinally end-most extremities of said block unit.

7. The building construction of claim 1, in which said bracket means comprises threaded elements paralleling the block unit length and interconnecting said adjacent block units end-wise to one another.

8. The building construction of claim 5, in which said rigidifying and connecting bracket means further comprises threaded elements paralleling the block length and interconnecting said adjacent similar blocks sidewise to one another adjacent apices of said straight intersecting frame sides.

9. The building construction of claim 2, in which said spanning strut element and two intersecting sides of the frame define a geometrically stable triangular outline resisting collapse of the frame in its plane, said strut element being fixedly connected to the frame adjacent opposite ends of said diagonal.

10. The building construction of claim 1, in which the block unit is equilateral, being pivotally collapsible about said interconnecting means to a relatively flat form for shipment and/or handling prior to assembly of said strut component thereto.

11. The building construction of claim 1, in which said frames have the outline of a parallelogram.

12. The building construction of claim 1, in which said frames have the outline of an equilateral parallelogram.

13. The building construction of claim 1, in which said frames have the outline of a rhombus.

* * * * *